US005793258A

United States Patent [19]

Lange

[11] Patent Number: 5,793,258

[45] Date of Patent: Aug. 11, 1998

[54] LOW CROSS POLARIZATION AND BROAD BANDWIDTH

[75] Inventor: Mark Lange, Oxnard, Calif.

[73] Assignee: California Amplifier, Camarillo, Calif.

[21] Appl. No.: 344,547

[22] Filed: Nov. 23, 1994

[51] Int. Cl.[6] ..... H01Q 1/42

[52] U.S. Cl. ..... 343/789; 343/700 MS; 343/753

[58] Field of Search ..... 343/700 MS, 702, 343/753, 789, 786, 872; H01Q 1/42, 9/44, 1/50

[56] References Cited

U.S. PATENT DOCUMENTS

| | | | |
|---|---|---|---|
| 2,588,610 | 3/1952 | Boolhhayd et al. | 343/872 |
| 4,295,141 | 10/1981 | Bogner | 343/753 |
| 4,821,040 | 4/1989 | Johnson et al. | 343/789 X |
| 5,010,348 | 4/1991 | Rene et al. | 343/789 X |
| 5,055,852 | 10/1991 | Dusseux et al. | 343/786 X |
| 5,083,132 | 1/1992 | Kanda et al. | 343/700 MS |
| 5,125,109 | 6/1992 | Geller et al. | 343/700 MS X |
| 5,280,297 | 1/1994 | Profera et al. | 343/700 MS X |

FOREIGN PATENT DOCUMENTS

| | | | |
|---|---|---|---|
| 2005922 | 4/1979 | United Kingdom | 343/700 MS |

*Primary Examiner*—Hezron Williams
*Assistant Examiner*—Tho Phan
*Attorney, Agent, or Firm*—Freilich, Hornbaker & Rosen

[57] ABSTRACT

An antenna/downconverter directed to the subscription television distribution industry having low cross polarization and broad bandwidth. The antenna/downconverter includes a director mounted to a housing which defines a reflector cup, side lobe suppression rim and a housing defining a chamber which provides environmental protection for downconverter electronics. Received microwave energy is coupled to the downconverter electronics from a point radially inward from the perimeter of a first receive disc axially spaced within the reflector cup using a probe surrounded by a conductive probe shield integral to the reflector cup. A second receive disc having a different radius than the first receive disc and axially spaced within the reflector cup is parasitically coupled to the first probe. The second receive disc additionally includes wings coupled to the perimeter of the reflector cup for shunting cross-polarized microwave signals. The housing defines a plurality of pairs of jaws which facilitate alignment to cross-polarized microwave signals when an installer receives a mounting mast in a selected one of the jaws.

13 Claims, 12 Drawing Sheets

LOW CROSS POLARIZATION AND BROAD BANDWIDTH

BACKGROUND OF THE INVENTION

The present invention relates to antenna/downconverters suitable for use at subscriber sites in a television distribution system for receiving microwave signals.

Subscription television service is typically provided either by hardwired cable systems or by "wireless cable" over-the-air systems. Wireless cable systems generally transmit at microwave frequencies (e.g., in the 2150–2162 and 2500–2686 MHz bands reserved for the Multichannel Multipoint Distribution System) from a "head end" distribution point to an antenna at each subscriber site. The microwave signals are typically polarized, either vertically or horizontally, to enhance signal to noise ratio.

An integrated microwave antenna/downconverter is disclosed in a commonly assigned application to Joel J. Raymond and Lawrence G. Crawford, Ser. No. 08/131,081, filed Oct. 1, 1993, which is incorporated herein by reference. The preferred embodiment described therein includes an integral multidisc director mounted to a reflector cup, side lobe suppression ears and a housing defining a chamber which provides environmental protection for downconverter electronics. Received microwave energy is coupled to the downconverter electronics via a probe from the perimeter of a receive disc, i.e., a microstrip patch, axially spaced from the reflector cup. Implementations of the described embodiment typically exhibit a bandwidth of ≈3.5% @ VSWR <1.5:1 and a cross polarization of ≈20 db. Attempts have been made in the prior art to broaden bandwidth by adding one or more parasitic microstrip patches or increasing the height of the microstrip patch above a conductive planar surface. However, increasing the height of the microstrip patch increases probe length rand can cause an undesirable increase in inductance. Other prior art attempts have been made to reduce cross polarization by using multiple feeds to the microstrip patch, but these attempts have increased manufacturing costs.

SUMMARY OF THE INVENTION

The present invention is directed to antenna/downconverters configured to provide broad bandwidth and low cross polarization in embodiments suited for use by subscription television subscribers to receive polarize microwave signals.

Embodiments of the present invention are configured to increase bandwidth and reduce cross polarization as contrasted with the prior art by 1) utilizing a probe shield for minimizing undesirable inductance and impedance mismatch of a probe used to interconnect a microstrip patch receive disc to downconverter electronics, 2) using an interconnection point on the microstrip patch radially inward from the perimeter of the receive disc to select its impedance, 3) using a second different-sized receive disc to broaden bandwidth, and 4) employing a pair of wings on the second receive disc having a cross-polarized orientation to shunt out undesirable cross-polarized signals.

Preferred embodiments of the invention are characterized by a planar conductive member having an electrically conductive reflector cup formed on a first side and a housing defining a chamber for accommodating downconverter electronics on a second aide. The reflector cup has an axially extending centrally located grounding post with an electrically conductive receive disc mounted thereupon for receiving microwave signals. A conductive probe is used to couple a microwave signal from a point radially inward from the perimeter of the receive disc to downconverter electronics by passing the probe through the conductive probe shield, extending from the receive disc to the housing accommodating the downconverter electronics.

Additionally, preferred embodiments include a second receive disc having a different axial spacing and radius from the first receive disc and further including wings extending to the perimeter of the reflector cup. The two receive discs are preferably enclosed within the reflector cup by a dielectric wafer and the reflector cup extends axially beyond the dielectric wafer as a side lobe suppression rim.

Preferred embodiments also include a mounting cover, mounted to the housing for enclosing the chamber containing the downconverter electronics, that has two pairs of diametrically opposed jaws for mounting the antenna/downconverter to a mast where each pair of jaws corresponds to a different polarized microwave signal, i.e., vertically or horizontally polarized. The planar conductive member, housing, reflector cup, grounding post and probe shield are integrally constructed of a single piece of metal in a preferred embodiment.

The novel features of the invention are set forth with particularity in the appended claims. The invention will be best understood from the following description when read in conjunction with the accompanying drawings.

DESCRIPTION OF THE PREFERRED EMBODIMENTS

The present invention relates to an antenna/downconverter suitable for use by television subscribers to selectively receive orthogonal (e.g., vertical or horizontal) polarized microwave signals. Embodiments of the present invention are configured to increase bandwidth and reduce cross polarization as contrasted with the prior art by 1) utilizing a probe shield for minimizing undesirable inductance and impedance mismatch of a probe used to interconnect a microstrip patch receive disc to downconverter electronics, 2) using an interconnector point on the microstrip patch radially inward form the perimeter of the receive disc to select its impedance, 3) using a second different-sized receive disc to broaden bandwidth, and 4) employing a pair of wings on the second receive disc having a cross-polarized orientation to shunt out undesirable cross-polarized signals. These features, which individually and collectively yield performance improvements over prior art antenna/downconverters, are discussed in detail below.

Figure 1:
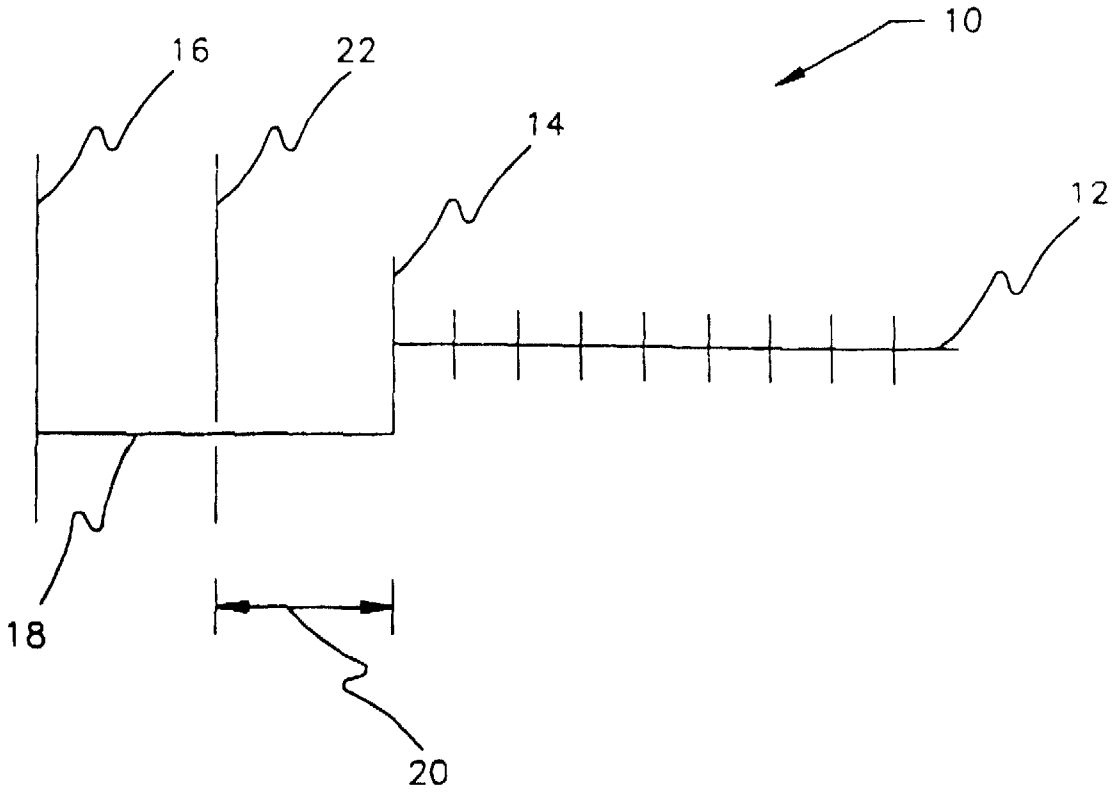
PRIOR ART FIG. 1
FIG. 1 comprises a simplified schematic side view of a prior art antenna/downconverter.
Figure 2:
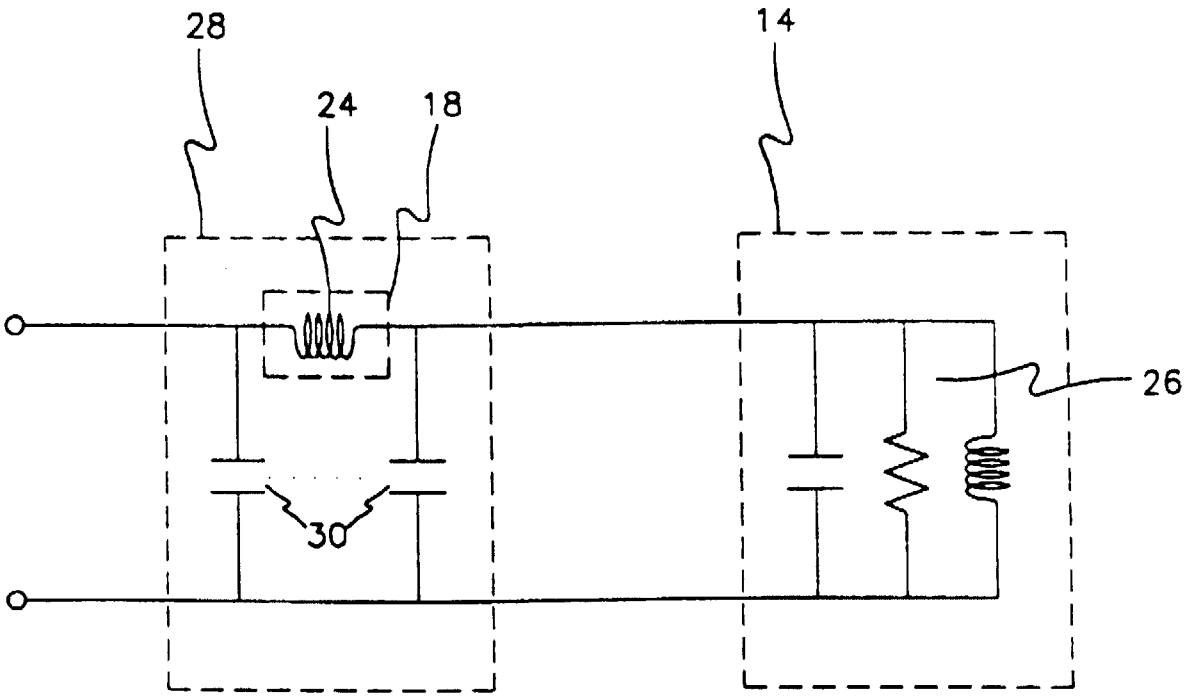
FIG. 2 in a schematic representation of the circuit elements formed in a preferred embodiment.

With reference to FIG. 1, there is shown a simplified schematic side view of a prior art antenna/downconverter 10 where a director 12 directs a microwave signal to a microstrip receive disc 14 which is coupled to downconverter electronics 16 via an interconnecting probe 18. It is well known that the bandwidth of such a device can be increased by increasing the height 20 of the microstrip patch with respect to a planar conductive member 22 which electrically functions as a ground plane. However, such a height increase undesirably increases the inductance of the probe 18, represented in FIG. 2 as inductance 24 and shown in relation to circuitry representing the microstrip patch 14. In accordance with the present invention, a probe shield 28 is incorporated to minimize the undesirable inductance 24 and distributively add capacitance in parallel with the probe 18.

Figure 3:
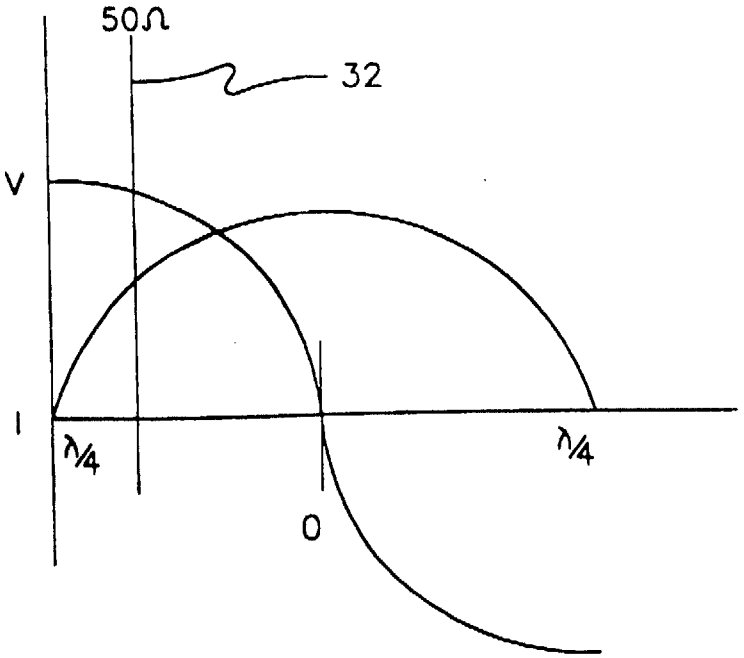
FIG. 3 is graphical representation of the current and voltage distribution on a microstrip patch receive disc caused by microwave stimulation.

Additionally, it is well known that the voltage and current characteristics of the microstrip patch receive disc 14, stimulated by a microwave signal of wavelength $\lambda$, vary approximately as shown in FIG. 3. Since the downconverter electronics 16 is typically characterized by a 50Ω input impedance, it is preferable to place the probe 18 at a point on the receive disc 14 that also exhibits a 50Ω impedance. Since, as shown in FIG. 3, the current flow is approximately zero at the perimeter of the receive disc 14, a probe connection point 32 should be chosen that is radially inward from the receive disc perimeter to achieve a V/I ratio of 50Ω.

While it is well known that bandwidth can be increased by incorporating an additional microstrip patch, parasitically coupled to the first microstrip patch 14, the present invention utilizes a specially configured second microstrip patch, described further below, with wings oriented to shunt out cross-polarized microwave signals.

Figure 4:
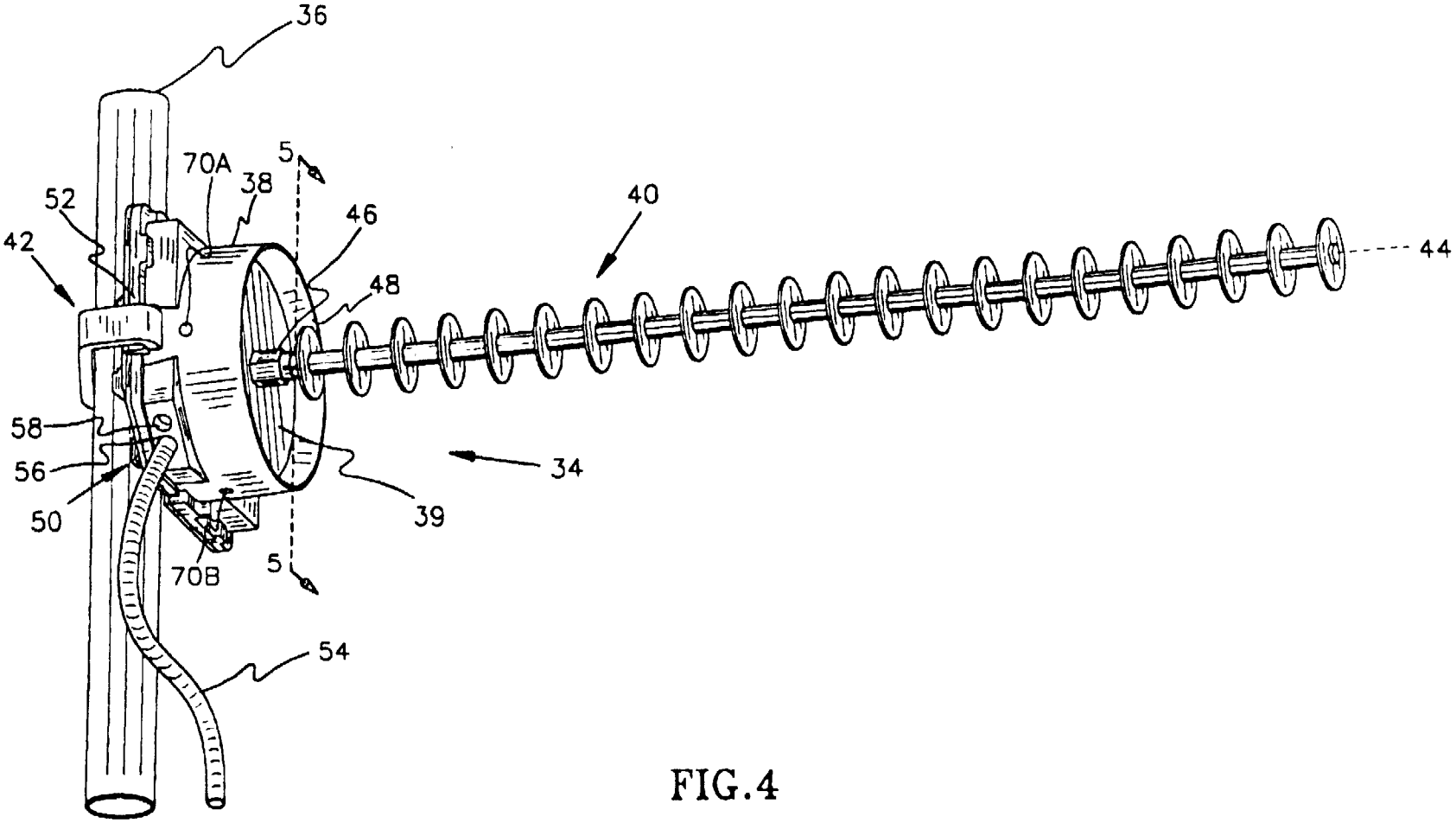
FIGS. 4 is an isometric view of a preferred antenna/downconverter embodiment in accordance with the present invention FIG. 5 comprises a side elevation view of the antenna/downconverter of FIG. 4 along the plane 5—5.

A preferred embodiment of an integrated microwave antenna/downconverter 34, in accordance with the present invention and illustrated in the isometric view of FIG. 4, is mounted to a vertically oriented most 36. To facilitate handling and installation, the antenna/downconverter 34 is preferably configured as three separate items, i.e., a housing assembly 38 containing an antenna 39 and the downconverter electronics 16, a director 40 and a clamp 42. The antenna 39 is primarily comprised of a reflector cup and at least and receive disc (described further below).

The housing assembly 38 and the clamp 42 are configured to cooperatively receive and grip the mast 36 for supporting the antenna/downconverter 34 to selectively receive signals having alternatively vertical or horizontal polarizations. The director 40 increases the gain of the antenna/downconverter 34 by directing microwave signals to the antenna 39. The director 40 defines an antenna axis 44 and is supported by a nut 46 mounted on a first face of the housing assembly 38. A side lobe suppression rim 48 is carried by the housing assembly 38 to reduce off-axis signals and increase on-axis gain.

The housing assembly 38 includes a mounting jaw system 50 arranged to selectively physically orient the housing assembly on the mast 36 in alignment with a selected microwave signal polarization. The housing assembly 38 also provides stops 52 which assist positioning the clamp 42 for each housing assembly orientation. These features facilitate mounting of the antenna/downconverter 34 by a single installer. A single coaxial drop cable 54, connected to an OUT connector 56, e.g. , an "F" type connector, coupled to the downconverter electronics 16, delivers a downconverted signal to receivers located below while the cable's center conductor additionally provides an upward path for DC voltage to power the downconverter electronics 16. Additionally, a TEST connector 58, e.g., an "F" type connector, is coupled to the downconverter electronics 16, proximate to the OUT connector 56, for providing an attenuated output signal for verification purposes.

In addition to its simple installation, the antenna/downconverter 34 is configured to reduce its fabrication and assembly time. For example, main parts of the housing assembly 38 can be cast as integral pieces and installation of the downconverter electronics 16 requires few steps other than a few soldering operations.

Figure 5:
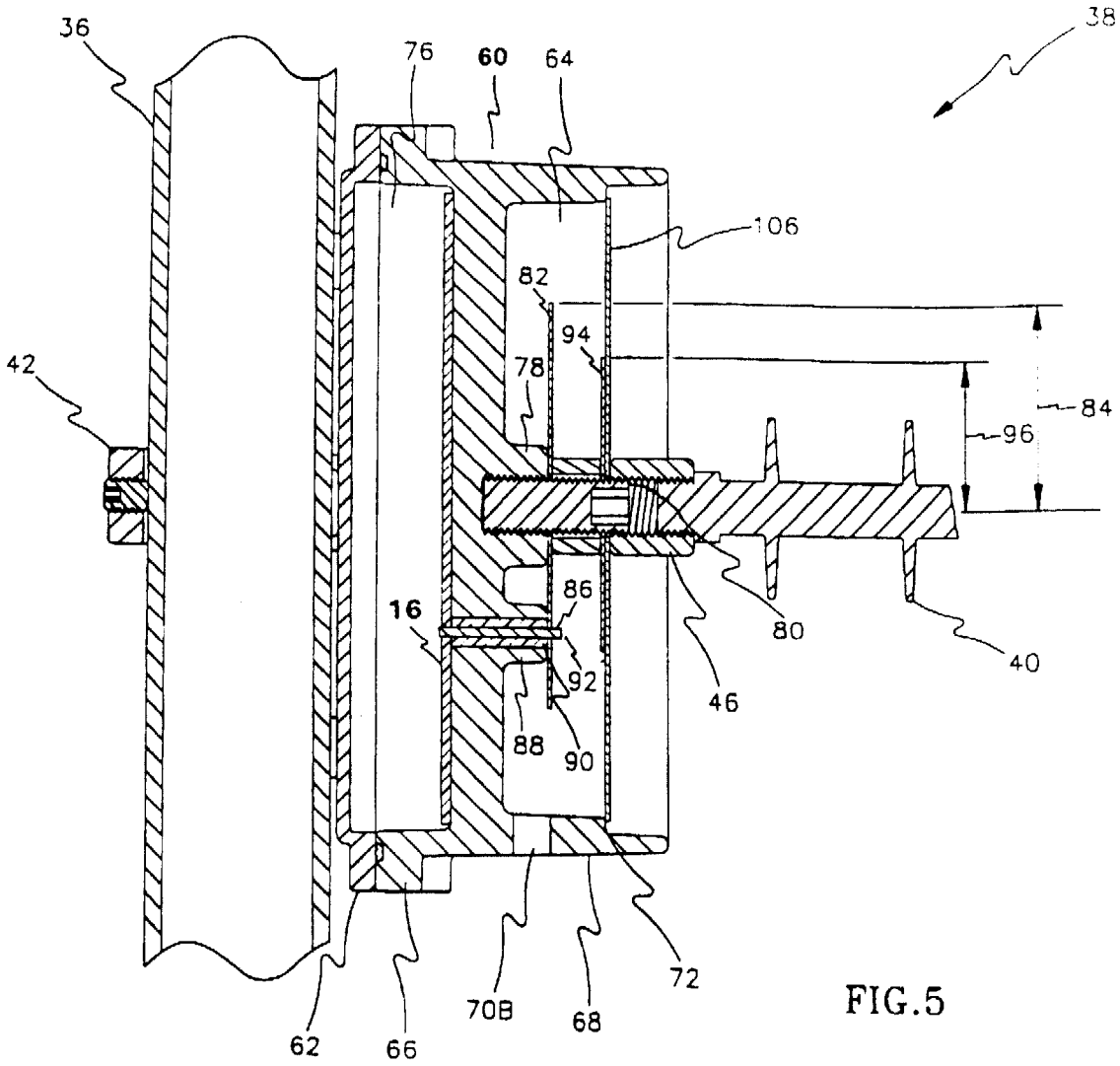
Figure 6:
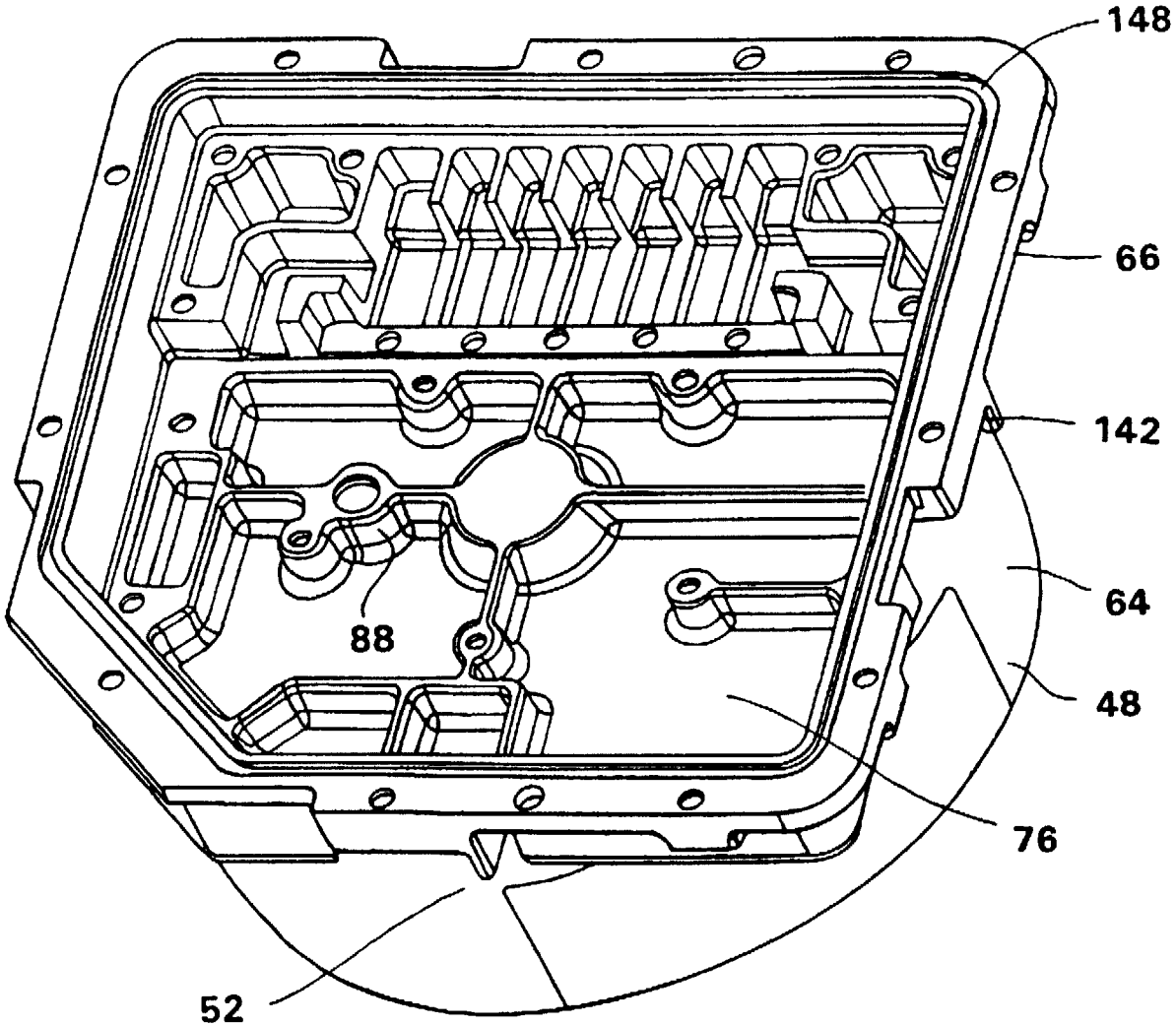
FIG. 6 is an isometric bottom view of the housing portion of the housing body.

FIG. 5 is a side elevation view of the antenna/downconverter 34 along the plane 5—5 as shown in FIG. 4. This view shown the housing assembly 38 to include a housing body 60 and a mounting cover 62. The housing body 60 defines a reflector cup 64 having a planar conductive member 66 as a back portion and an annular rim 68. The annular rim 68 is interrupted by radial drain holes 70 and defines an annular step 72 at the top edge of its inner side forming the side lobe suppression rim 48. The housing body 60 is divided into essentially two portions divided by the planar conductive member 66 to separate the reflector cup 64 from a housing 76 defining a chamber used to receive the downconverter electronics 16. The planar conductive member 66 is integrally formed as a transverse web, also shown in an isometric view of the housing 76 in FIG. 6, which defines, in the center of the reflector cup 64, a grounding post 78, formed an a forward directed boom, that receives a threaded stud 80.

Figure 9:
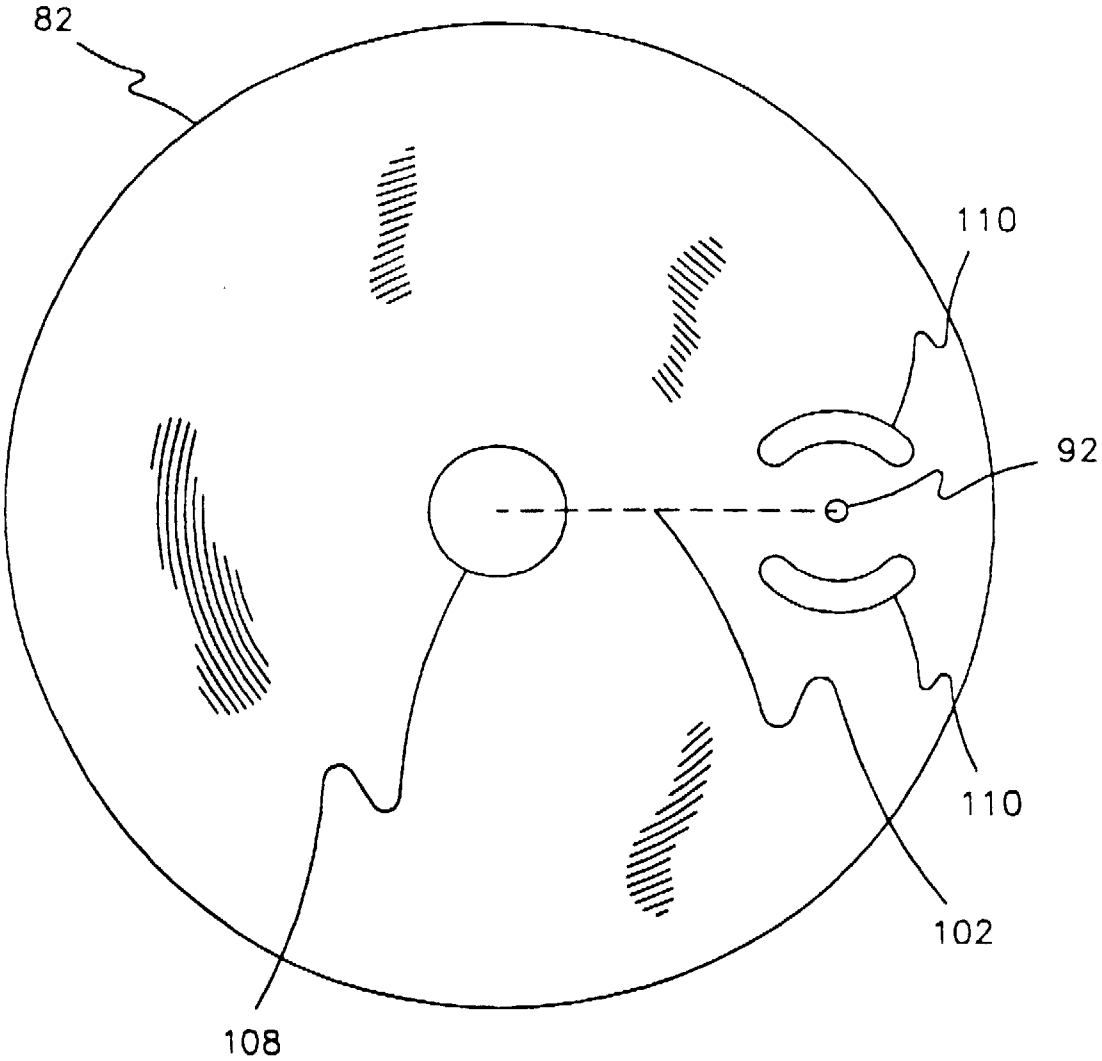
FIG. 9 is a top view of the first receive disc.

A microstrip patch in the form of a first receive disc 82 (also shown in FIG. 9), having a centrally located circular cutout, is mounted around the threaded stud 80 on the grounding post 76. The first receive disc 82 receives the microwave signals directed to it from the director 40. The first receive disc 82 is sized to have a first microwave resonant frequency $F_1$ and wavelength $\lambda_1$ corresponding to the lower end of the desired bandwidth. The first receive disc 82 sits on the grounding post 78. The dimension 84 from the central axis 44 to the perimeter of the first receive disc 82 is set to a value of $\lambda_1/4$. The first receive disc is spaced from the planar conductive member 66 by the axial dimension of the grounding post 78.

A probe 86 is used to interconnect the selected polarized microwave signal from the first receive disc 82 to the downconverter electronics 16. The downconverter electronics 16 is fabricated as a microstrip circuit board and is secured within the housing 76 with standard hardware. As described in the previously referenced application, the downconverter electronics 16 functions to downconvert a selected microwave signal received via the probe 86 to a lower signal frequency signal compatible with a typical television receiver. As previously described, this signal is output to the coaxial drop cable 54 via the OUT connector 56. The probe 86 is soldered at a first and to the downconverter electronics 16 and at a second end to the first receive disc 82. An electrically conductive probe shield 88 is formed as a forward directed boss from the planar conductive member 66 radially offset in the reflector cup 64. The probe shield 88 defines a centrally located cavity extending from the reflector cup 64 to the chamber defined by the housing 76 and preferably extending within the housing 76 to the downconverter electronics 16. A dielectric insulator 90 is disposed between the probe shield 88 and the probe 86 to insulate the probe 86 from the probe shield 88.

An interconnection point 92 for the second and of the probe 86 is chosen corresponding to a 50Ω impedance on the first receive disc 82 that in radially inward from the perimeter of the first receive disc 82 and it is this point 92 that determines the radial location of the probe shield 88. For example, the impedance of the receive disk can be measured at two different radial locations and the interconnection point 92 can be found through interpolation of the measured impedances versus the two radial locations. As a consequence of the use of the probe shield 88 and the radially inward interconnect point 92, the input impedance of the downconverter electronics 16 is nominally matched to the probe 86 and to the first receive disc 82 for the reasons previously described.

Figure 7:
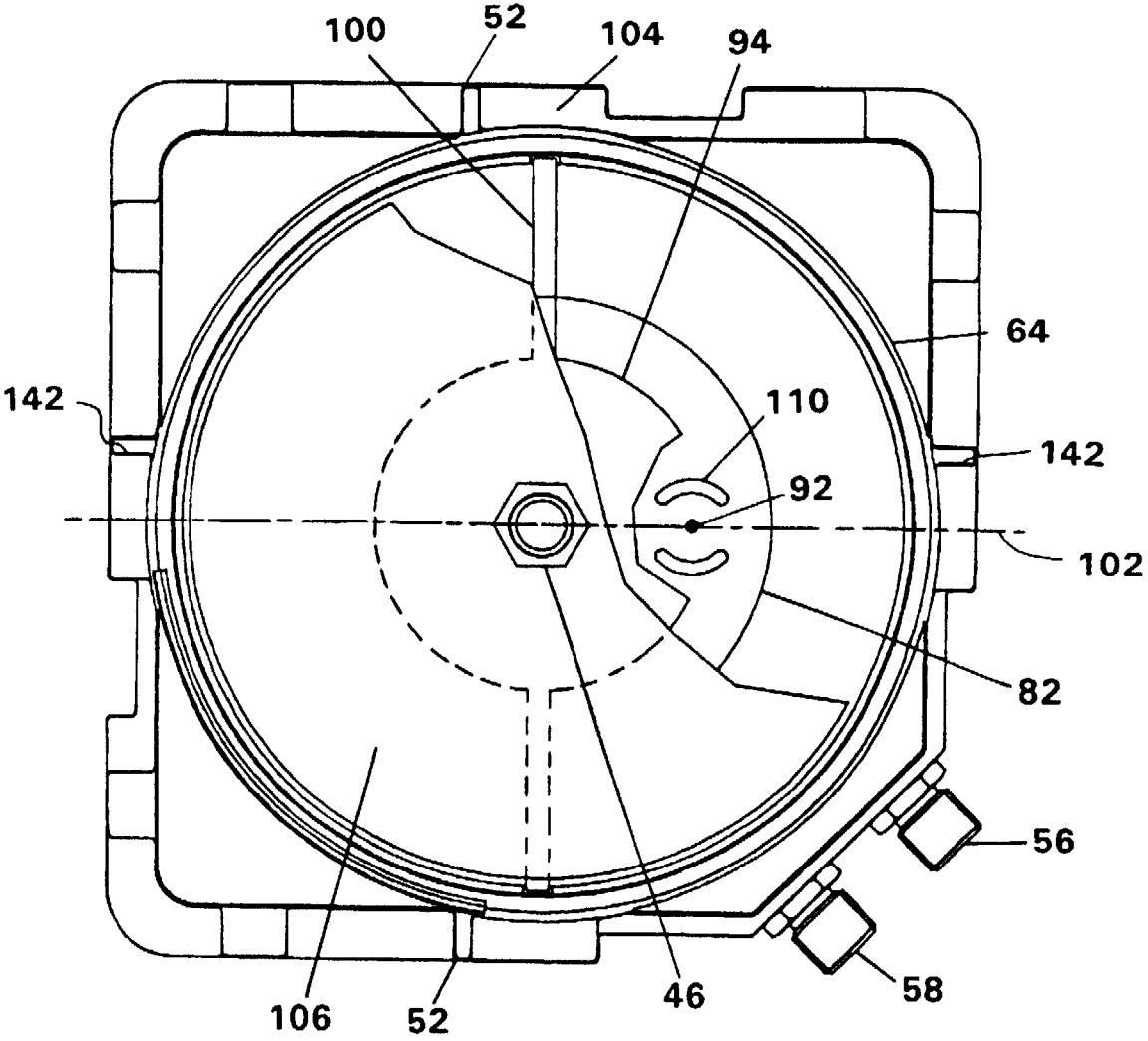
FIG. 7 is a cutaway top view of the reflector cup.
Figure 8:
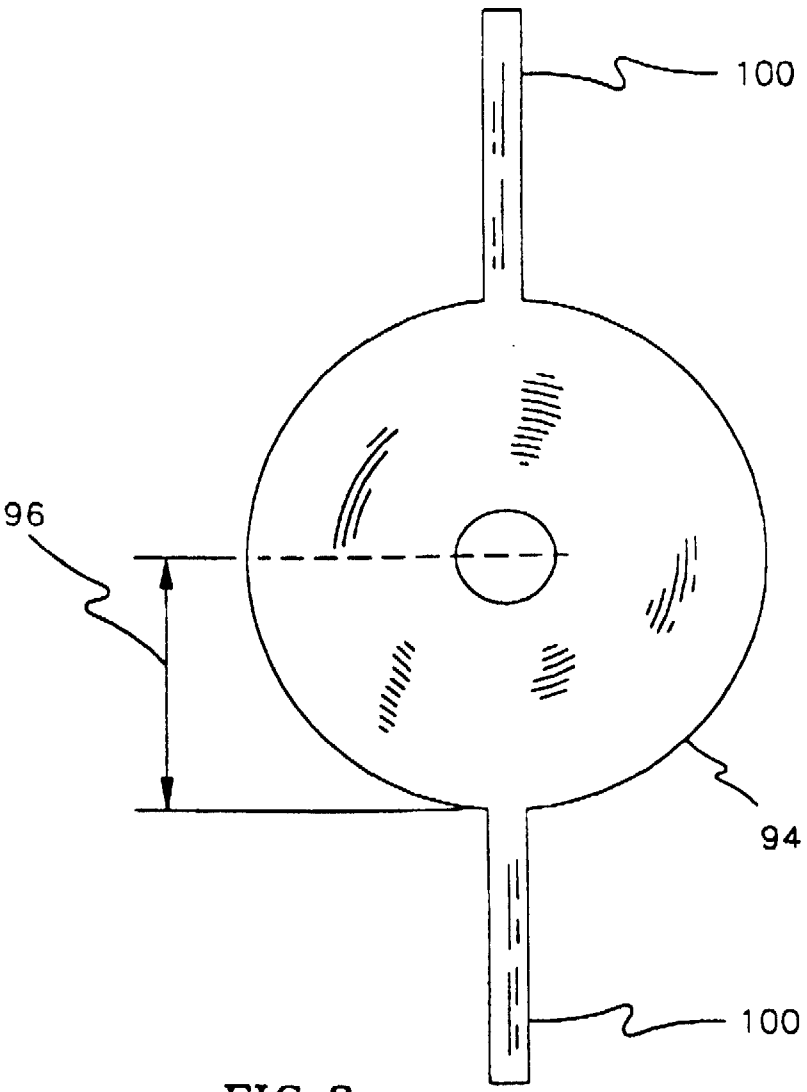
FIG. 8 is a top view of the second receive disc.

A second receive disc 94 (also shown in FIG. 8) has a second radial dimension 96 corresponding to a second microwave resonant frequency $F_2$ and wavelength $\lambda_2$, the upper end of the desired bandwidth. The second receive disc 94 is elevated from the first receive disc 82 by a conductive hollow spacer 98. The second receive disc 94 site on the spacer 98. The dimension 96 extending from the central axis 44 to the perimeter of the second receive disc 94 is set to a value of $\lambda_2/4$. The second receive disc 94 in parasitically coupled to the first receive disc 82, resulting in a broadened bandwidth. With reference to FIG. 7, there is shown a cutaway top view, looking along the plane 7—7 and down the antenna axis 44, of the reflector cup and the second receive disc 94. The second receive disc 94, also shown in FIG. 8, additionally includes a pair of diametrically opposed wings 100 that radially extend to the perimeter of the reflector cup 64. The wings 100 are oriented perpendicular to a receive axis 102, passing through the interconnection point 92 and the center of the grounding post 78. To assist in positioning the wings 100, a pair of depressed steps 104 are located diametrically opposed in the annular rim 68. The antenna/downconverter 34 is optimized for microwave signals having an electrical field polarization corresponding to the receive axis 102. Thus, as previously described, the wings 100 tend to shunt out undesirable cross-polarized microwave signals.

With reference again to FIG. 5, a flat dielectric wafer 106 functions as a radome. The wafer has a center hole which receives the stud 80 while the perimeter of the wafer 104 is received into the annular stop 72 formed in the periphery of the reflector cup 64. The nut 46 is threaded onto the stud 80 to secure the receive discs 82 and 94, spacer 98 and wafer 104 within the reflector cup 64. The nut 46 additionally receives the director 40 as shown in FIG. 4.

The first receive disc 82 is preferably fabricated from a highly conductive material, e.g., tin plated (to facilitate soldering and enhance corrosion resistance) copper sheet. Disc 82 (FIG. 9) defines a first hole 108 at its center and a second hole at the interconnection point 92, radially offset from its perimeter. A pair of arcuate slots 110 facilitate soldering the probe 86 to the disc 82 by reducing thermal flow away from the interconnection point 92. The second receive disc 94 must also be electrically conductive but it need not be solderable and thus can be fabricated from other materials, e.g., aluminum.

The housing body 60, comprised of the planar conductive member 66, the housing 76, the reflector cup 64, the grounding post 78 and the probe shield 88 are preferably cast as integral pieces of an electrically conductive material such as aluminum or magnesium, resulting in improved performance and lower manufacturing coats. The mounting cover 62 in preferably manufactured of the same material as the housing body 60. It should be understood that other embodiments of the housing may define equivalent bodies and covers having boundaries along contours other than those shown in the figures.

The housing assembly 38 thus defines a portion of an antenna/downconverter 34 optimized for efficiently coupling a selected vertical or horizontal polarized microwave signal from the director 40 to the downconverter electronics 16. In a test of a preferred embodiment of the present invention, a high bandwidth of approximately 42%, i.e., $(F_2-F_1)/F_c$ where $F_c=(F_2+F_1)/2$, and a low cross polarization of −28 dB were achieved.

Figure 10B:
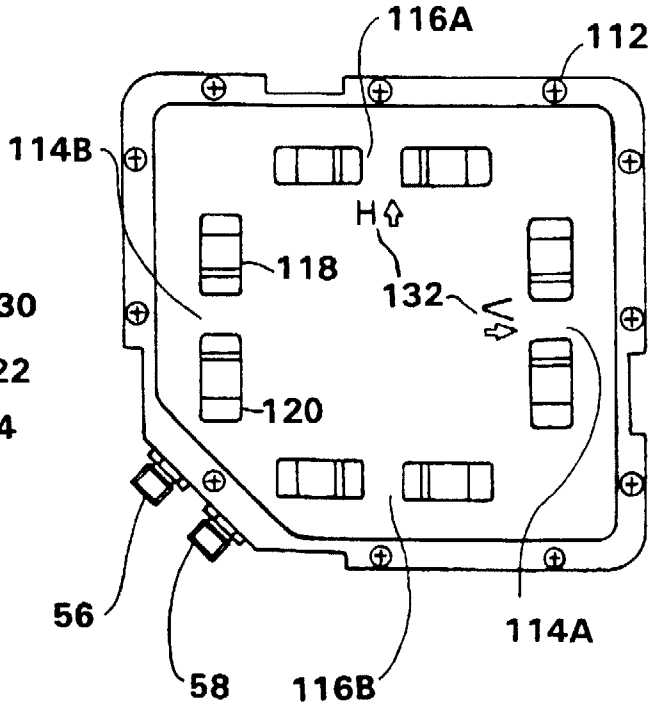
FIGS. 10A and 10B are respectively side and rear views of a preferred embodiment of the present invention showing the mounting plate portion of the jaw system.
Figure 10A:
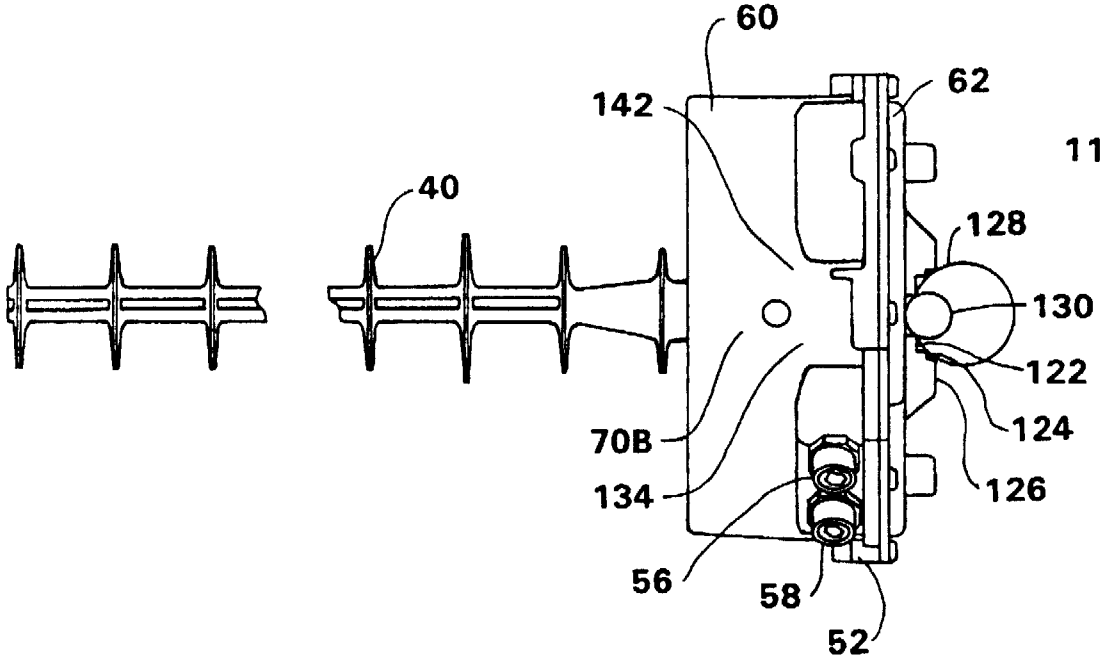

With reference now to FIGS. 10A and 10B, there are respectively shown aide and rear views of a preferred embodiment of the present invention showing a mounting plate portion of the jaw system 50 attached to the housing body 60 by standard hardware 112. The jaw system 50 is comprised to two pairs of diametrically opposed jaws, each corresponding to a selected microwave signal. The mast 36 (shown in FIG. 4) is gripped either by a vertical pair of jaws 114 corresponding to the receive axis 102 for a vertically polarized microwave signal or a horizontal pair of jaws 116, oriented perpendicular to the receive axis 102. Each jaw is comprised of a pair of bosses 118 and 120 on an outer surface of the mounting cover 62, each having a plurality of ascending steps 122, 124, 126 arranged to engage variously sized masts. For illustrative purposes, a first diameter mast 128 is shown to be gripped by stops 126 while a second diameter mast 130, narrower than the first diameter mast 128, is shown to be gripped by steps 122, closer to the surface of the mounting cover 62. As shown, indicia 132 are cast into the mounting cover 62 to aid the installer in aligning with the desired electric field. For example, if the installer wishes to align the antenna/downconverter 34 with a horizontally polarized microwave signal, he rotates the housing assembly 38 until the indicia "H3" is at the upper side of the mounting cover 62 as in FIG. 1CB.

Figures 11, 12:
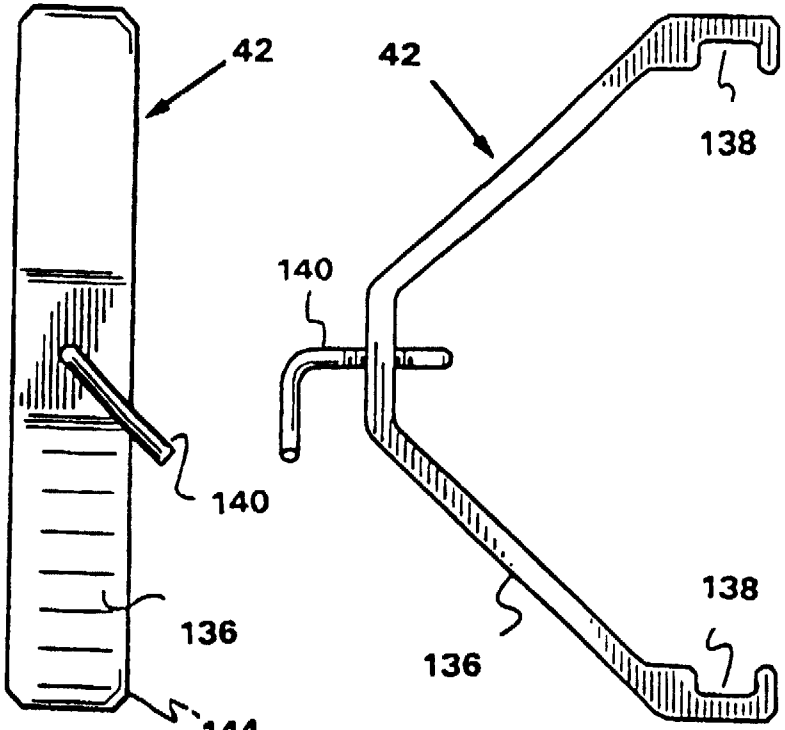
FIGS. 11 and 12 are respectively roar and side views of the clamp.

A pair of diametrically opposed steps 134 (FIG. 10A) for coupling to the clamp 42 are defined on the housing body 60 proximate to the housing 76 on an opposite side from the mounting cover 62. The clamp 42, as shown in respective rear and side views of FIGS. 11 and 12, includes a yoke 136 which forms diametrically opposed grooves 138 to slidingly receive the steps 134 and allow the yoke 136 to embrace the mast 36 between itself and the mounting cover 62. The clamp 42 also includes a clamp screw 140 that is threaded through the yoke 136 to compressingly abut the mast 36.

As shown in FIGS. 7 and 10A, the housing body 60 defines a pair of stops 142, each extending axially forward and radially outward. The yoke 136 may be slid upward to firstly engage the steps 134 with the yoke grooves 138 and secondly abut the stops 52 with an upper side 144 of the yoke 136. The stops 52 thus position the yoke 136 on the housing assembly 38 while an installer is tightening the clamp screw 140 against the mast 36. With the yoke 136 prevented from sliding upward, the antenna/downconverter 34 can also be allowed to tilt downward until the yoke 136 and lower horizontal jaw 116B (see FIG. 10D) abut the mast 36 to relieve most of the weight from the installer. The vertical pair of stops 52 are defined by the mounting cover 62 to cooperate in a similar manner with the yoke 136 when the mast 36 is respectively received in jaw pairs 114A and 114B.

When the antenna/downconverter 34 is installed on a mast 36 as in FIG. 4, the side lobe suppression rim 48 and dielectric wafer 106 shield the receiving discs 82 and 94 from the weather. To prevent retention of moisture that might accumulate in the reflector cup 64 (e.g., from condensation), the two radial drain holes 70 are circumferentially spaced 90 degrees and positioned so that one of them is downward in each angular relationship of the antenna/downconverter 34 and mast 36. For example dan shown in the vertical polarized orientation of FIG. 4 the hole 70B is positioned to drain away any accumulated moisture.

Figure 13:
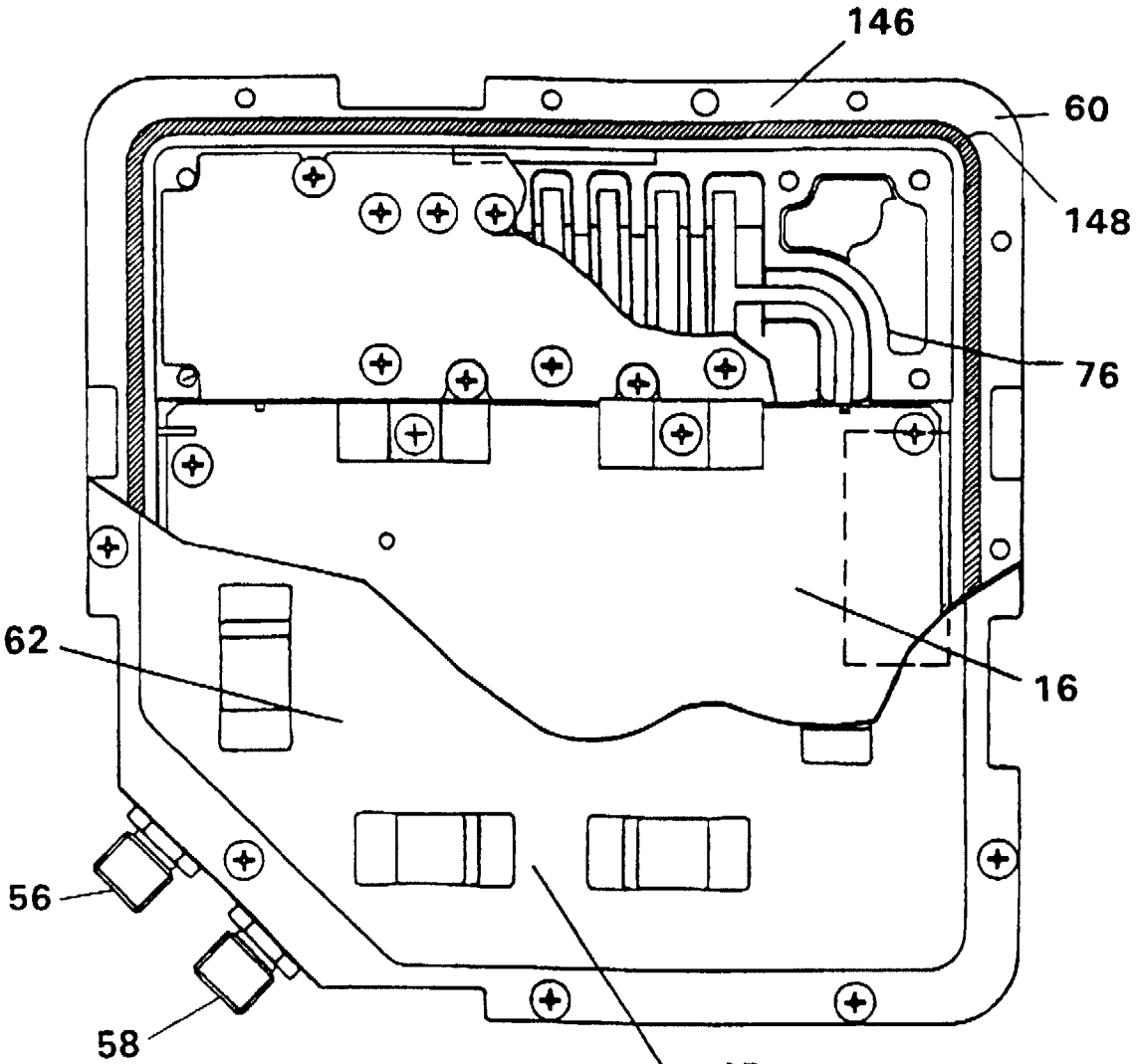
FIG. 13 is a cutaway view of FIG. 10B showing the O-ring seal of the mounting cover to the housing body.

As shown in figure and FIG. 13, a cutaway view of the mounting cover 62, the housing body 60 and mounting cover 52 are physically sealed to environmentally protect the downconverter electronics 16 with the aid of an O-ring 146 received in an groove 148 which in defined in the housing body 60.

Although the present invention has been described in detail with reference only to the presently-preferred embodiments, those of ordinary skill in the art will appreciate that various modifications can be made without departing from the invention. Accordingly, the invention is defined by the following claims.

I claim:

1. A microwave antenna/downconverter suitable for use by subscription television subscribers to deliver selected orthogonally polarized microwave signals to downconverter electronics, comprising;

a planar electrically conductive member having first and second sides, a housing defining a chamber formed on said second side of said planar electrically conductive member for accommodating said downconverter electronics:

an electrically conductive reflector cup formed on said first side of said planar electrically conductive member and defining an axis, said cup having a centrally located grounding post;

a first electrically conductive receive disc for receiving said microwave signals, said disc axially spaced from said planar electrically conductive member within said reflector cup and centrally mounted to said grounding post;

a second electrically conductive receive disc axially spaced from said planar electrically conductive member within said reflector cup and coupled to said around post at an axial spacing and radius different from said first receive disc; said second receive disc additionally comprising a pair of diametrically opposed wings extending to the perimeter of said reflector cup;

a dielectric wafer disposed across said cut to enclose said first and second receive discs;

an axially oriented electrically conductive probe shield defining a cavity extending from said chamber through said planar electrically conductive member to a point radially inward from the perimeter of said first receive disc;

an electrically conductive probe centrally located within said cavity and electrically isolated from said probe shield directly coupling said first receive disc to said downconverter electronics through said probe shield; and a side lobe suppression rim formed by axially extending said reflector cup beyond said first and second receive discs and said dielectric wafer.

2. A microwave antenna/downconverter suitable for use by subscription television subscribers to deliver selected orthogonally polarized microwave signals to downconverter electronics, comprising:

a planar conductive ember having first and second sides;

a housing defining a chamber formed on said second side of said planar conductive member for receiving said downconverter electronics;

an electrically conductive reflector cup formed on said first side of said planar conductive member and defining an axis, said cup having a centrally located grounding post;

a first electrically conductive receive disc for receiving said microwave signals, said disc axially spaced from said planar conductive member within said reflector cup and centrally coupled to said grounding post;

means for coupling said microwave signals from said first receive disc to said downconverter electronics, said means distributively adding capacitance;

means for impedance matching said microwave signal at said first receive disc to said downconverter electronics and means for shunting out microwave signals orthogonally polarized to said selected signals.

3. The antenna/downconverter of claim 2, wherein said coupling means comprises an axially extending electrically conductive probe shield defining a cavity from said chamber defined by said housing through said planar conductive member to a point radially inward from the perimeter of said first receive disc.

4. The antenna/downconverter of claim 3, wherein said planar conductive member, said housing, said reflector cup, said grounding post and said probe shield are integrally constructed of a single piece of metal.

5. The antenna/downconverter of claim 3, wherein said probe shield additionally extends within said chamber defined by said housing to said downconverter electronics.

6. The antenna/downconverter of claim 3, wherein said coupling means additionally comprises:

an electrically conductive probe centrally located within said cavity and electrically isolated from said probe shield directly coupling said first receive disc to said downconverter electronics: and a dielectric insulator disposed within said probe shield between said electrically conductive probe and said probe shield.

7. The antenna/downconverter of claim 2 wherein said moans for impedance matching comprises connecting a conductive probe to a point radially inward from the perimeter of said first receive disc.

8. The antenna/downconverter of claim 2, wherein said means for shunting out microwave signals comprise a second electrically conductive receive disc axially spaced from said planar conductive member within said reflector cup and coupled to said ground post at an axial spacing and radius different from said first receive disc and having a pair of diametrically opposed wings extending to the perimeter of said reflector cup.

9. The antenna/converter of claim 8, additionally comprising a dielectric wafer disposed across said cup to enclose said first and second receive discs.

10. The antenna/downconverter of claim 9, additionally comprising a side lobe suppression rim formed by axially extending said reflector cup beyond said first and second receive discs and said dielectric wafer.

11. The antenna/downconverter of claim 2, additionally comprising a mounting cover for enclosing said chamber defined by said housing wherein the outer surface of said mounting cover is comprised of two pairs of diametrically opposed jaws for receiving a mast, each pair of jaws corresponding to a selected polarized microwave signal.

12. The antenna/downconverter of claim 11, further including a clamp carried by said housing to grip said mast between said clamp and a selected pair of said jaws.

13. The antenna/downconverter of claim 2, additionally comprising a director mounted to said grounding pout for directing said microwave signals to said first receive disc.

* * * * *